US009637948B2

(12) United States Patent
Choi

(10) Patent No.: US 9,637,948 B2
(45) Date of Patent: May 2, 2017

(54) RAM ASSEMBLY ON TOP OF TENT

(71) Applicant: CAMPVALLEY (XIAMEN) CO., LTD, Xiamen (CN)

(72) Inventor: Kwanjun Choi, Xiamen (CN)

(73) Assignee: Campvalley (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 14/762,139

(22) PCT Filed: Dec. 18, 2013

(86) PCT No.: PCT/CN2013/089748
§ 371 (c)(1),
(2) Date: Dec. 16, 2015

(87) PCT Pub. No.: WO2014/110955
PCT Pub. Date: Jul. 24, 2014

(65) Prior Publication Data

US 2016/0115708 A1 Apr. 28, 2016

(30) Foreign Application Priority Data

Jan. 18, 2013 (CN) ..... 2013 2 0027238 U

(51) Int. Cl.
*E04H 15/64* (2006.01)
*E04H 15/46* (2006.01)
*E04H 15/16* (2006.01)

(52) U.S. Cl.
CPC ..... *E04H 15/64* (2013.01); *E04H 15/46* (2013.01); *E04H 15/16* (2013.01); *E04H 15/646* (2013.01)

(58) Field of Classification Search
None
See application file for complete search history.

(56) References Cited

U.S. PATENT DOCUMENTS 1,061,547 A 5/1913 Kennedy
1,347,107 A 7/1920 McCann
1,623,154 A * 4/1927 Abercrombie ..... E04H 15/28 135/123

(Continued)

FOREIGN PATENT DOCUMENTS

CN 1030791 C 1/1996
CN 2012176152 U 3/2012

(Continued)

OTHER PUBLICATIONS

International Search Report for International Patent Application No. PCT/CN2013/089748 mailed Mar. 6, 2014, 2 pages.

*Primary Examiner* — David R Dunn
*Assistant Examiner* — Danielle Jackson
(74) *Attorney, Agent, or Firm* — Morgan, Lewis & Bockius LLP

(57) ABSTRACT

Disclosed is a ram assembly for use on the top of a tent where tops of supporting rods of the tent are connected to a top connecting seat. The ram assembly includes at least one ram connected to the top connecting seat and located between two adjacent supporting rods. The ram assembly supports an eave tarpaulin and allows the eave tarpaulin to unfold. The eave tarpaulin is located on the top of the tent and between at least the two adjacent supporting rods. An outer edge of the cave tarpaulin sleeves on the ram. The ram assembly is an elastic telescopic rod.

13 Claims, 4 Drawing Sheets

(56) References Cited

U.S. PATENT DOCUMENTS

| | | | | |
|---|---|---|---|---|
| 3,333,594 | A * | 8/1967 | Moss | B60P 3/343 135/147 |
| 3,834,410 | A * | 9/1974 | Leibel | E04H 15/425 135/123 |
| 4,944,321 | A | 7/1990 | Moyet-Ortiz | |
| 5,240,020 | A * | 8/1993 | Byers | A47C 7/66 135/155 |
| 5,284,172 | A * | 2/1994 | Teate, Jr. | A45B 25/02 135/27 |
| 6,463,948 | B2 | 10/2002 | Lee | |
| 6,899,112 | B2 * | 5/2005 | Tsai | E04H 15/50 135/131 |
| 7,316,239 | B2 | 1/2008 | Yang | |
| 7,401,618 | B2 * | 7/2008 | Caldwell | A45B 11/00 135/33.2 |
| 7,509,967 | B2 * | 3/2009 | Kim | E04H 15/28 135/120.2 |
| 8,360,085 | B2 * | 1/2013 | Lee | E04H 15/48 135/135 |
| 8,701,688 | B2 * | 4/2014 | Vaughn | E04H 15/16 135/94 |
| D705,884 | S | 5/2014 | Jin | |
| 8,910,648 | B2 | 12/2014 | Jin | |
| 2001/0050098 | A1 | 12/2001 | Lee | |
| 2002/0066239 | A1 | 6/2002 | Gillis | |
| 2012/0055525 | A1 * | 3/2012 | Choi | E04H 15/48 135/147 |
| 2013/0014794 | A1 | 1/2013 | Jin | |
| 2014/0202512 | A1 * | 7/2014 | Jin | E04H 15/46 135/140 |
| 2014/0238456 | A1 * | 8/2014 | Jin | E04H 15/48 135/147 |
| 2014/0261601 | A1 | 9/2014 | Jin | |
| 2014/0290710 | A1 | 10/2014 | Choi | |
| 2014/0338710 | A1 * | 11/2014 | Huang | E04H 15/32 135/120.3 |
| 2015/0083177 | A1 | 3/2015 | Hotes | |

FOREIGN PATENT DOCUMENTS

| | | |
|---|---|---|
| CN | 203113900 U | 8/2013 |
| FR | 1 121 851 | 8/1956 |
| FR | 68588 | 5/1958 |
| KR | 10-2007-0009501 A | 1/2007 |
| WO | WO 2011/022764 A1 | 3/2011 |

* cited by examiner

RAM ASSEMBLY ON TOP OF TENT

CROSS-REFERENCE TO RELATED APPLICATION

The present application claims priority of International Application Number PCT/CN2013/089748 filed Dec. 18, 2013, which claims priority of Chinese Patent Application Number 201320027238.4 filed Jan. 18, 2013, the entire contents of which applications are incorporated herein for all purposes by this reference.

FIELD OF INVENTION

The present invention relates to a tent, and in particular, to a ram on the top of a tent.

DESCRIPTION OF RELATED ART

A tent has become a necessary outdoor tool for those who are fond of outdoor recreational activities such as traveling, camping, and nature enjoying. A tent is mainly composed of a tarpaulin and a tent frame used to support the tarpaulin, the space inside the tent unfolded is limited, and the tarpaulin is closely knit, leading to a poor air permeability, a poor ventilation, and thus a poor air quality inside the tent, so that some tents are provided with vents formed by mesh fabrics on the top. In order to provide the vents with a ventilation function as well as a sunshine and rain shading effect without manually opening or closing the covering tarpaulin above the vents, as shown in FIG. 1, the tops of each set of supporting rods 1' of the tent are pivoted together through a pivot seat 2'; the tarpaulin 3' is connected on each of the supporting rods 1', the top of the tarpaulin 3' is provided with a mesh vent 31', and at least one ram 4' is pivoted on the pivot seat 2' on the top of the tent frame. The ram 4' is located above the mesh vent 31', the ram 4' is connected to eave tarpaulin 32' formed above the vent, and both sides of the eave tarpaulin 32' are connected to the tarpaulin on both sides of the mesh vent.

With respect to the above tent structure, during folding, each of the supporting rods 1' of the tent is usually folded upwards, and unfolded downwards during unfolding, and each of the supporting rods 1' is erected after forming an opening angle therebetween. The ram 4' is accompanied by the folding and unfolding of the supporting rods, since the eave tarpaulin 32' is connected to the ram 4' and is tightly stretched and supported, in the process of folding or unfolding, when the eave tarpaulin 32' on both sides of the ram 4' cooperates with the folding upwards or moving downwards to unfolding, the eave tarpaulin 32' often get dragged. Since the eave tarpaulin is connected to the tarpaulin and is in a tightly stretched state, the tarpaulin may be easily ruptured when the eave tarpaulin is dragged, a long term of stretching of the eave tarpaulin connected between the ram and the two supporting rods may cause the eave tarpaulin to be baggy and affect the appearance, and in the process of folding and unfolding of the tent, the eave tarpaulin along with the tarpaulin are also easily dragged and thus torn up, therefore the lifetime of the tarpaulin is affected.

SUMMARY OF INVENTION

The objective of the present invention is to provide a ram on the top of a tent, which is located on the top of the tent to support eave tarpaulin of the tent, and can prevent the tarpaulin from being stretched and damaged during unfolding and folding process of the tent.

In order to achieve the above objective, the solution of the present invention is:

a ram on the top of a tent, wherein tops of supporting rods of the tent are connected to a top connecting seat; at least one ram is connected to the top connecting seat and located between two adjacent supporting rods; eave tarpaulin located on the top of the tent is formed between at least one set of the two adjacent supporting rods; the outer edge of the eave tarpaulin sleeves on the ram and is supported to unfold; and the ram is an elastic telescopic rod.

An elastic body is matched on the ram to form the elastic telescopic rod.

The elastic body is a spring abutting against the front end of the ram; a spring sleeve sleeves outside the spring, and the length of the spring sleeve is larger than the free length of the spring; and a spring fixing seat is further arranged on the end portion of the outer side of the spring sleeve.

The spring sleeve along with the ram are sleeved inside a cloth bushing arranged at the outer edge of the eave tarpaulin, and the length of the cloth bushing is larger than the length of the spring sleeve.

The elastic body is a spring abutting against the front end of the ram; and the ram and the spring are sleeved in the cloth bushing connected to the outer edge of the eave tarpaulin.

The cloth bushing is sewn on the eave tarpaulin and is provided in the middle with a sleeve having a length larger than the length of the spring unfolded, and the spring and the ram are sleeved in the sleeve.

The ram forms an elastic telescopic rod by an inner bushing and an outer bushing in conjunction with the spring, and one end of one of the two bushings is matched with the outer edge of the eave tarpaulin.

After the above structure is adopted, the ram of the present invention can be elastically adjusted to a certain extent, so that when the tent needs to be folded, when the eave tarpaulin on the ram cooperates the supporting rods on both sides for folding or unfolding, since the ram is automatically retractable for achieving proper motion adjustments, the problem that the tightly stretched eave tarpaulin along with the tarpaulin are directly dragged and damaged can be avoided, and when the ram supports and unfolds the eave tarpaulin, the elastic body located inside the ram can also make the eave tarpaulin be tightly stretched and not baggy.

DETAILED DESCRIPTION

In order to further explain the technical solution of the present invention, detailed description is given on the present invention with reference to the following specific examples.

Figure 1:
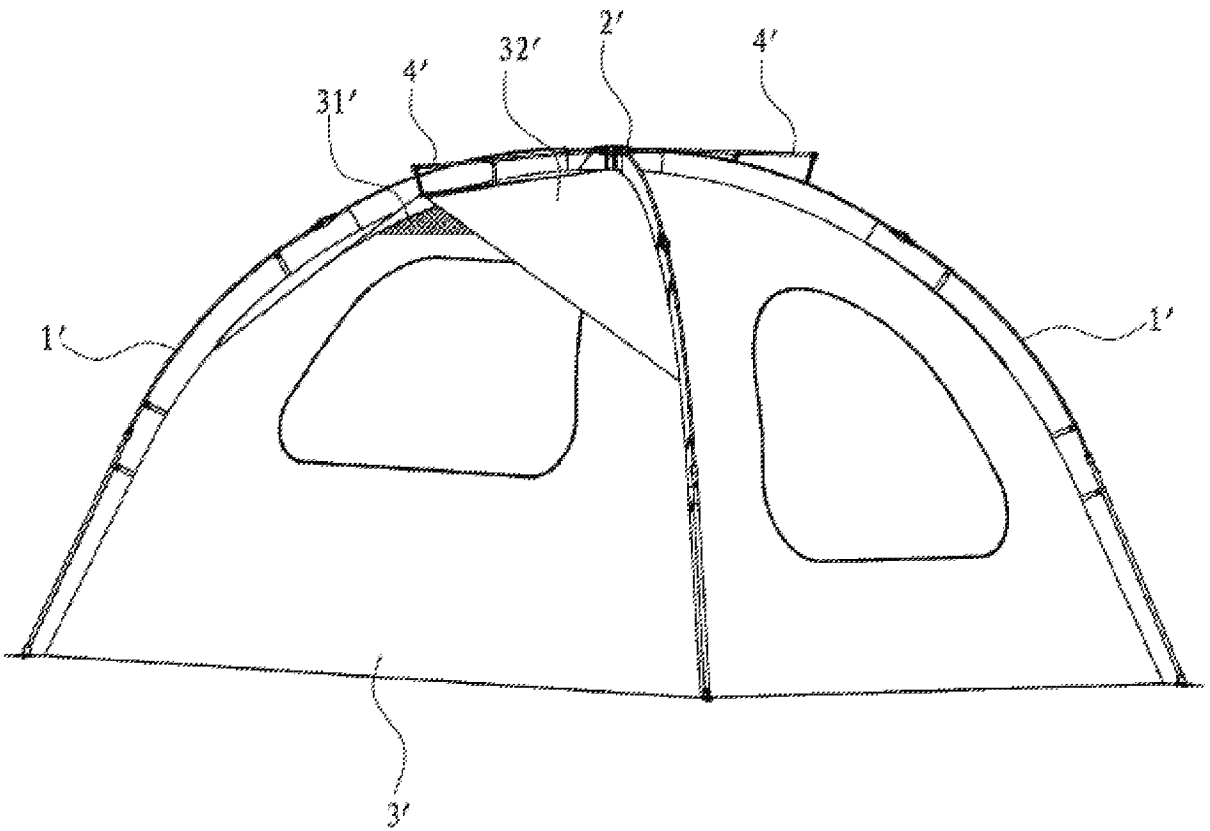
FIG. 1 is a schematic structural view of an existing tent.
Figure 2:
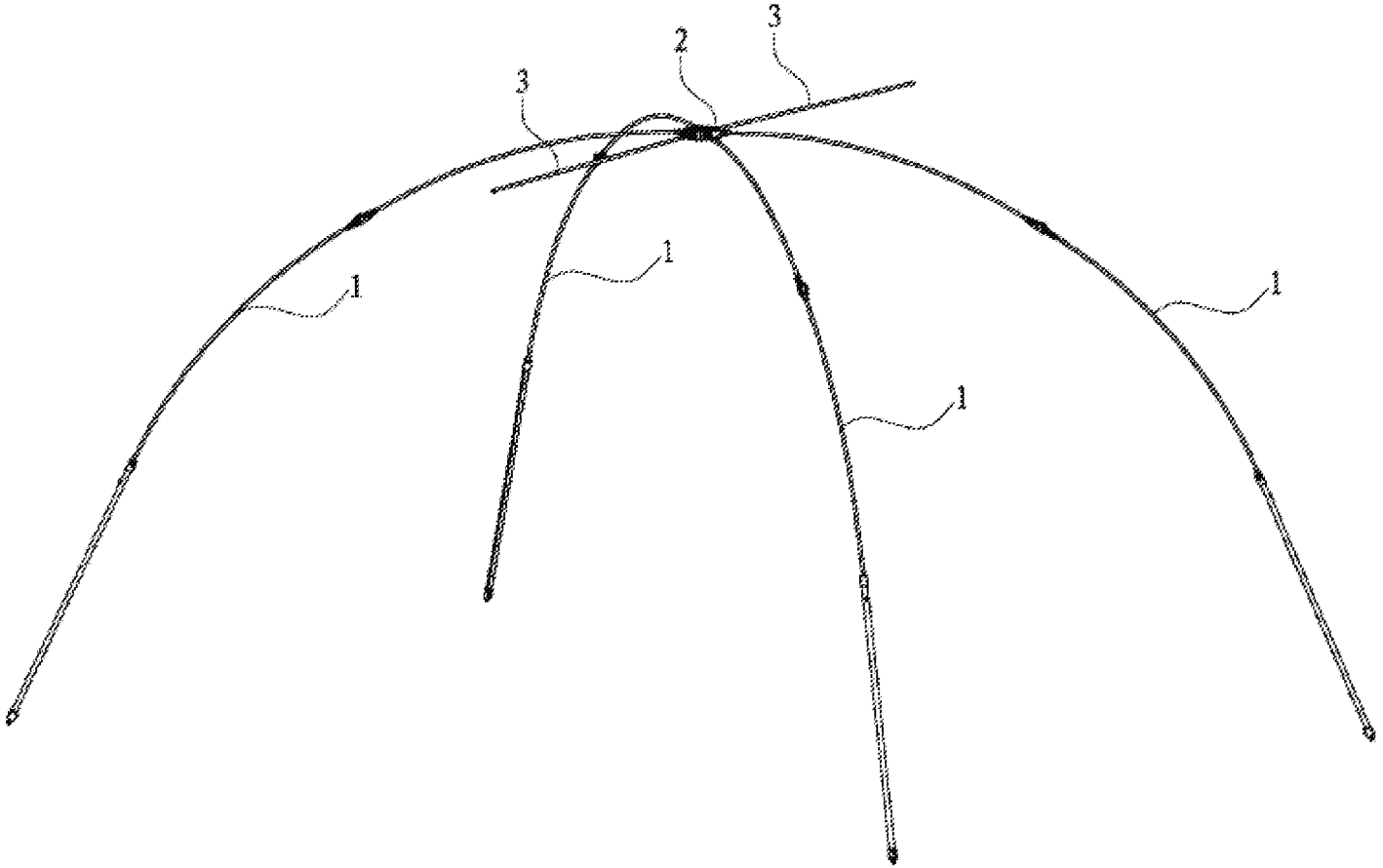
FIG. 2 is a schematic structural view in the tent implemented by the present invention.

As shown in FIG. 2, and with reference to FIG. 1, the ram 3 on the top of the tent of the present invention is disposed between two adjacent supporting rods 1. Top ends of the supporting rods 1 are connected to a top connecting seat 2. The ram 3 is connected to the top connecting seat 2 of the tent. The ram 3 for supporting the eave tarpaulin of the tent is disposed between the two tent supporting rods 1. There can be more than one ram 3 for supporting the unfolded eave tarpaulin to protect the vents arranged on the top of the tent. An upper surface of the eave tarpaulin sleeves on the ram (not shown in the drawings), and both sides thereof are connected to the tarpaulin. When the tent is unfold, the eave tarpaulin forms an eave at the top of the tent.

The major improvement of the present invention lies in that, the ram 3 is, or the ram assembly includes, an elastically adjustable rod, which is automatically extendable and retractable for achieving proper adjustments. An elastic body can be coupled with the ram 3 to form an elastically adjustable rod, so that the overall length of the elastically adjustable rod can be changed and adjusted in a certain range. Thereby, when the eave tarpaulin sleeving on the ram is folded along with a tent frame rod, the tarpaulin connected to the ram has a space for stretching. When the tent is unfolded, the ram supports the eave tarpaulin, the elastic body rebounds or extends forward so that the eave tarpaulin is tightly stretched and is prevented from drooping or dangling. In order to achieve the above objective, two examples are listed below to illustrate the structure of the ram assembly of the present invention.

Figure 3:
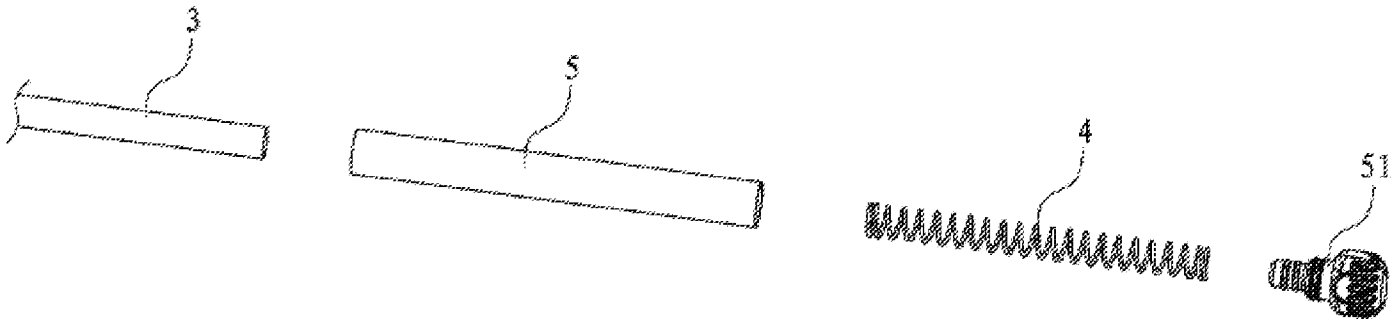
FIG. 3 is a schematic structural view of a first example of the present invention.

As shown in FIG. 3, in an embodiment, the elastic body is a spring 4 abutting against a front end of the ram 3. In this example, the elastic body is set on the front end of the ram, and the outer diameter of the spring 4 is smaller than the outer diameter of the ram, so that the spring 4 is located in the front of the ram 3 instead of sleeving on the ram 3. The spring sleeve 5 sleeves the spring 4, the front portion of the ram 3 is also located inside the spring sleeve 5. The length of the spring sleeve 5 is longer than the free length of the spring 4. A spring fixing seat 51 is further arranged on the end portion of the outer side of the spring sleeve 5, so that the spring 4 is located within the spring sleeve 5, and abuts against the front end of the ram 3. Finally, a cloth bushing corresponding to the ram 3 is arranged on the outer edge of the eave tarpaulin for sleeving on the ram. The length of the cloth bushing is longer than the length of the spring sleeve 5. In this way, the eave tarpaulin is connected to the ram. The spring sleeve 5, in which the spring 4 is received, is then inserted in the cloth bushing of the eave tarpaulin, so that the ram 3 supports the eave tarpaulin when the tent is unfolded.

Figure 4:
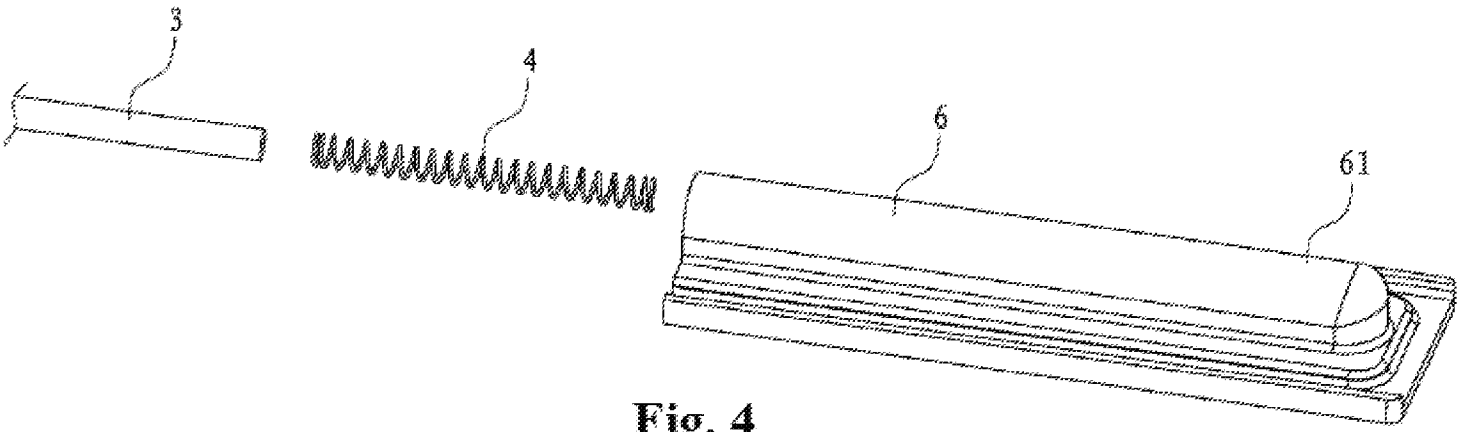
FIG. 4 is a schematic structural view of a second example of the present invention.

As shown in FIG. 4, in another embodiment, the elastic body is a spring 4 directly abutting against the front end of the ram 3. The spring sleeve is not needed, instead the spring 4 is directly set in the cloth bushing 6 connected to the eave tarpaulin. A sleeve 61 is set in the middle of the cloth bushing 6 for sleeving the spring 4 and the ram 3. The length of the sleeve 61 is longer than the length of the unfolded spring 4. The cloth bushing 6 sleeves the spring 4 as well as the front end portion of the ram 3. The spring 4 abuts against the front end of the ram 3 and is fixed. Meanwhile, the cloth bushing 6 is fixed on the eave tarpaulin, for example, both sides of the cloth bushing 6 are directly sewn in the middle portion adjacent the outer edge of the eave tarpaulin. The ram 3 along with the spring 4 is inserted into the sleeve 61 of the cloth bushing 6 to support the eave tarpaulin when the tent is unfolded.

Of course, the elastic body of the ram assembly in the present invention can also be disposed in the middle portion of the ram. For example, in an embodiment, the ram is made of an inner tube and an outer tube, which are slidably coupled to each other by the spring. One end of the inner or outer tube is coupled to the outer edge of the eave tarpaulin, the eave tarpaulin is connected to the ram, and the ram is automatically and elastically extendable and retractable.

The ram assembly of the present invention includes an elastically adjustable rod, the length of which can be elastically adjusted to a certain extent. An elastic body can be coupled with the ram to form the elastically adjustable rod. In an example, the elastically adjustable rod is formed by an inner tube and an outer tube slidably coupled to each other by the spring. As the overall length of the ram assembly of the present invention is automatically adjustable, the ram assembly of the present invention eliminates or reduces the risk of damaging the tent tarpaulin and the eave tarpaulin during folding and unfolding of the tent. In addition, the ram assembly of the present invention supports the eave tarpaulin and prevents the eave tarpaulin from drooping or dangling when the tent is unfolded.

The above examples and drawings are not used to limit the forms and patterns of products of the present invention, and any appropriate changes or modifications made by those of ordinary skill in the art should be deemed to be not departing from the patent scope of the present invention.

What is claimed is:

1. A ram assembly for use in a tent, wherein the tent comprises a top connecting seat, a plurality of supporting rods each connected to the top connecting seat, a tent tarpaulin supported by the plurality of supporting rods, and a first eave tarpaulin disposed above and connected to the tent tarpaulin, the ram assembly comprising:

a first ram connected to the top connecting seat of the tent, and having a front end;

a first elastic body having an outer diameter less than a diameter of the first ram;

a first spring sleeve sleeving the first elastic body and a front portion of the first ram, and having an open front end; and a first spring fixing seat removably coupled to the open front end of the first spring sleeve, wherein the first spring sleeve is received in a first cloth bushing fixed on the first eave tarpaulin at a location adjacent an outer edge of the first eave tarpaulin, and wherein the first elastic body has a first end abutting the front end of the first ram, and a second end abutting the first spring fixing seat, thereby facilitating automatic extension or retraction of the ram assembly to reduce the risk of damaging the tent tarpaulin and the first eave tarpaulin during folding and unfolding of the tent, and to prevent the first eave tarpaulin from drooping or dangling when the tent is unfolded.

2. The ram assembly of claim 1, wherein the first spring sleeve has a length longer than a free length of the first elastic body.

3. The ram assembly of claim 1, wherein the first cloth bushing has a length longer than the first spring sleeve.

4. The ram assembly of claim 1, wherein the first cloth bushing is sewn on an outer surface of the first eave tarpaulin.

5. The ram assembly of claim 1, wherein the first elastic body is a spring.

6. The ram assembly of claim 1, wherein the tent further comprises a second eave tarpaulin disposed above and connected to the tent tarpaulin, the ram assembly further comprising:

a second ram connected to the top connecting seat of the tent, and having a front end;

a second elastic body having an outer diameter less than a diameter of the second ram;

a second spring sleeve sleeving the second elastic body and a front portion of the second ram, and having an open front end; and a second spring fixing seat removably coupled to the open front end of the second spring sleeve, wherein the second spring sleeve is received in a second cloth bushing fixed on the second eave tarpaulin at a location adjacent an outer edge of the second eave tarpaulin, and wherein the second elastic body has a first end abutting the front end of the second ram, and a second end abutting the second spring fixing seat, thereby facilitating automatic extension or retraction of the ram assembly to reduce the risk of damaging the tent tarpaulin and the second eave tarpaulin during folding and unfolding of the tent, and to prevent the second eave tarpaulin from drooping or dangling when the tent is unfolded.

7. A tent comprising the ram assembly of claim 1.

8. A ram assembly for use in a tent, wherein the tent comprises a top connecting seat, a plurality of supporting rods each connected to the top connecting seat, a tent tarpaulin supported by the plurality of supporting rods, and a first eave tarpaulin disposed above and connected to the tent tarpaulin, the ram assembly comprising:

a first ram connected to the top connecting seat of the tent, and having a front end;

a first elastic body having an outer diameter less than a diameter of the first ram, and a first end fixed at the front end of the first ram; and a first sleeve disposed inside of a first cloth bushing fixed on the first eave tarpaulin at a location adjacent an outer edge of the first eave tarpaulin, wherein the first elastic body and a front portion of the first ram is inserted into the first sleeve such that the first elastic body abuts the first sleeve, thereby facilitating automatic extension or retraction of the ram assembly to reduce the risk of damaging the tent tarpaulin and the first eave tarpaulin during folding and unfolding of the tent, and to prevent the first eave tarpaulin from drooping or dangling when the tent is unfolded.

9. The ram assembly of claim 8, wherein the first sleeve has a length longer than a free length of the first elastic body.

10. The ram assembly of claim 8, wherein the first cloth bushing is sewn on an outer surface of the first eave tarpaulin.

11. The ram assembly of claim 8, wherein the first elastic body is a spring.

12. The ram assembly of claim 8, wherein the tent further comprises a second eave tarpaulin disposed above and connected to the tent tarpaulin, the ram assembly further comprising:

a second ram connected to the top connecting seat of the tent, and having a front end;

a second elastic body having an outer diameter less than a diameter of the second ram, and a first end fixed at the front end of the second ram; and a second sleeve disposed inside of a second cloth bushing fixed on the second eave tarpaulin at a location adjacent an outer edge of the second eave tarpaulin, wherein the second elastic body and a front portion of the second ram is inserted into the second sleeve such that the second elastic body abuts the second sleeve, thereby facilitating automatic extension or retraction of the ram assembly to reduce the risk of damaging the tent tarpaulin and the second eave tarpaulin during folding and unfolding of the tent, and to prevent the second eave tarpaulin from drooping or dangling when the tent is unfolded.

13. A tent comprising the ram assembly of claim 8.

* * * * *